US008535073B2

(12) United States Patent
Oiri et al.

(10) Patent No.: US 8,535,073 B2
(45) Date of Patent: Sep. 17, 2013

(54) CONNECTOR

(75) Inventors: Nobuyasu Oiri, Tokyo (JP); Masakazu Kuroiwa, Tokyo (JP); Yusuke Obata, Tokyo (JP); Yoshinobu Yamamoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/478,611

(22) Filed: May 23, 2012

(65) Prior Publication Data

US 2012/0302086 A1 Nov. 29, 2012

(30) Foreign Application Priority Data

May 26, 2011 (JP) ..... 2011-117784
May 26, 2011 (JP) ..... 2011-117944
May 26, 2011 (JP) ..... 2011-118042

(51) Int. Cl.
*H01R 13/62* (2006.01)

(52) U.S. Cl.
USPC ..... 439/157; 439/372

(58) Field of Classification Search
USPC ..... 439/372, 157
See application file for complete search history.

(56) References Cited

U.S. PATENT DOCUMENTS

| | | | | |
|---|---|---|---|---|
| 7,063,548 | B2 * | 6/2006 | Ohara | 439/157 |
| 7,384,286 | B2 * | 6/2008 | Imai et al. | 439/157 |
| 7,410,374 | B2 * | 8/2008 | Okuda et al. | 439/157 |
| 8,007,298 | B2 * | 8/2011 | Komiyama et al. | 439/157 |
| 2001/0044228 | A1 * | 11/2001 | Noro et al. | 439/157 |
| 2010/0323537 | A1 * | 12/2010 | Vasbinder et al. | 439/65 |
| 2012/0302086 | A1 * | 11/2012 | Oiri et al. | 439/372 |

FOREIGN PATENT DOCUMENTS

| | | | |
|---|---|---|---|
| JP | 2008-41417 | A | 2/2008 |
| JP | 2008-204718 | A | 9/2008 |

* cited by examiner

*Primary Examiner* — James Harvey
(74) *Attorney, Agent, or Firm* — Holtz, Holtz, Goodman & Chick, PC

(57) ABSTRACT

The connector matable with a mating connector comprises a housing, a lever and an attached member. The housing has a front end, a rear end and an accommodating portion. The accommodating portion communicates with the front end and the rear end. The accommodating portion has an upper portion, a lower portion and side portions. The side portions are formed on respective opposite ends in a width direction of the accommodating portion so as to couple the upper portion and the lower portion with each other. The lever is configured to mate the connector with the mating connector and accommodated in the accommodating portion so as to be pivotable. The attached member is other than the housing. The attached member is attached to the housing so as to couple the upper portion and the lower portion with each other at a position located between the side portions in the width direction.

20 Claims, 12 Drawing Sheets

CONNECTOR

CROSS REFERENCE TO RELATED APPLICATIONS

Applicants claim priority under 35 U.S.C. §119 of Japanese Patent Applications No, JP2011-117784, No. JP2011-117944 and No. JP2011-118042 each filed May 26, 2011.

BACKGROUND OF THE INVENTION

This invention relates to a connector comprising a lever, wherein the connector is configured to be mated with a mating connector when the lever is operated to pivot.

For example, this type of connectors is disclosed in JP-A 2008-41417 or JP-A 2008-204718, contents of which are incorporated herein by reference. The connector of JP-A 2008-41417 or JP-A 2008-204718 comprises a housing and a lever. The housing is formed with an accommodating portion. The lever is accommodated in the accommodating portion so as to be pivotable between a first position and a second position.

In detail, the lever of the connector of JP-A 2008-41417 or JP-A 2008-204718 is pivotable between the first position and the second position through a predetermined position. The connector of JP-A 2008-41417 or JP-A 2008-204718 is tentatively matable (i.e. partially matable) with the mating connector when the lever is located in the vicinity of the first position (including the first position). After the mating connector is tentatively mated with the connector, the lever is operated to pivot toward the second position so that the mating connector and the connector are (completely) mated with each other. On the other hand, when the lever pivots toward the second position beyond the predetermined position, the mating connector is unable to be tentatively mated with the connector. Accordingly, it is impossible to (completely) mate the mating connector with the connector. Hereinafter, the predetermined position (i.e. a boundary for the mating connector to be tentatively matable with the connector) is referred to as a "third position". As can be seen from the above description, the third position is located between the first position and the second position. The mating connector is tentatively matable with the connector when the lever is located between the first position and the third position.

The connector of JP-A 2008-41417 or JP-A 2008-204718 is provided with a resilient lock portion. The resilient lock portion regulates a position of the lever so as to certainly make the connector and the mating connector to be tentatively mated with each other. More specifically, the resilient lock portion is configured so as to temporarily receive the lever (i.e. temporarily lock the lever) at the third position when the lever located in the vicinity of the first position is forced to pivot toward the second position. In other words, the resilient lock portion temporarily prevents the lever from pivoting toward the second position beyond the third position. The resilient lock portion is resiliently deformed by the mating connector when the mating connector is tentatively mated with the connector so that the lever locked by the resilient lock portion is released from the resilient lock portion.

Moreover, the connector of JP-A 2008-204718 is configured so that a part of the lever (lever-side abutment portion) is brought into abutment with a part formed on a front end of the housing (housing-side abutment portion) when the lever is located at the first position. As for the connector of JP-A 2008-204718, the abutment of the lever-side abutment portion with the housing-side abutment portion prevents the lever from pivoting beyond the first position so as to be apart from the second position.

When the aforementioned lever is installed in the housing during the assembly process of the connector, it is necessary to prevent the lever and the housing (especially, the accommodating portion of the housing) from being damaged. Accordingly, it is preferable that the accommodating portion has a flexible upper portion (or top plate). However, if the upper portion of the accommodating portion has flexibility, the lever might be removed from the housing after installed within the accommodating portion. Therefore, the connector is required to have a structure which prevents the lever installed within the accommodating portion from coming out of the accommodating portion while allowing the lever to be easily installed into the accommodating portion during the assembly process of the connector. In other words, the connector is required to have a structure considering a force applied to the upper portion of the accommodating portion from the lever (i.e. a force applied to the lever).

The lever is located between the second position and the third position when the lever is installed in the housing. Especially, the lever is located at the second position by the factory setting. The lever located at the second position is operated to pivot toward the first position beyond the third position so that the connector becomes tentatively matable. The resilient lock portion is required to be resiliently deformed easily when the lever passes through the third position. On the other hand, the resilient lock portion is required not to be resiliently deformed easily when the resilient lock portion prevents the lever from pivoting toward the second position beyond the third position. The connector is required to have a structure which satisfies the aforementioned two requirements which seem to be inconsistent with each other. In other words, the connector is required to have a structure considering a force applied from the lever to the resilient lock portion (i.e. a force applied to the lever).

The accommodating portion and the lever of the aforementioned connector are formed with a pivot shaft and a shaft receiver, respectively. Thus formed lever may be formed with a guide channel. The guide channel guides the pivot shaft to the shaft receiver of the lever so that the lever can be easily installed in the accommodating portion by the guide channel. Thus formed guide channel is located at a front side of the housing when the lever is installed in the accommodating portion. Therefore, it is desirable that the lever does not receive a backward force from the front side of the housing. However, it is unavoidable that the lever receives the backward force from the front side of the housing when the housing-side abutment portion (i.e. a part which determines a pivoting limit of the lever) is located at the front side of the housing like the connector shown in JP-A 2008-204718. When the lever receives the force, a part of the lever, which located at the front side of the housing, is lifted. The lever has the guide channel so that the shaft receiver of the lever may be easily removed from the pivot shaft by a small upward movement of the lever.

A distance between an operated portion of the lever and a pivoting center of the lever is required to be longer than a distance between a pinion formed on the lever and the pivoting center of the lever so as to mate the connector with the mating connector by operating the lever with a small force. The lever should be configured not to protrude from the housing undesirably long so that a possibility that the lever is damaged is lowered as much as possible. There is also a need not to make the lever undesirably large. If the part which determines the pivoting limit of the lever is formed on the front end of the housing like the connector of JP-A 2008-204718, it is difficult to make a distance between the pivoting center of the lever and the lever-side abutment portion long while satisfying the aforementioned requirements.

On the other hand, If the part which determines the pivoting limit of the lever is formed on the rear end of the housing, the part may interfere the lever when the lever is installed into the accommodating portion.

As can be seen from the above description, the connector is required to have a structure considering a force applied from the lever to the part which determines the pivoting limit of the lever (i.e. a force applied to the lever).

SUMMARY OF THE INVENTION

It is therefore an object of the present invention to provide a connector which has structures considering the aforementioned various forces applied to the lever.

One aspect (first aspect) of the present invention provides a connector matable with a mating connector. The connector comprises a housing, a lever and an attached member. The housing has a front end, a rear end and an accommodating portion. The accommodating portion communicates with the front end and the rear end. The accommodating portion has an upper portion, a lower portion and side portions. The side portions are formed on respective opposite ends in a width direction of the accommodating portion so as to couple the upper portion and the lower portion with each other. The lever is accommodated in the accommodating portion so as to be pivotable between a first position and a second position through a third position. The lever is configured to mate the connector with the mating connector when the lever pivots to the second position after the mating connector is inserted into the connector from the front end under a state where the lever is located between the third position and the first position. The attached member is other than the housing. The attached member is attached to the housing so as to couple the upper portion and the lower portion with each other at a position located between the side portions in the width direction.

Another aspect (second aspect) of the present invention provides a connector matable with a mating connector. The connector comprises a housing, a lever and an attached member. The housing has a front end, a rear end, an accommodating portion and a resilient lock portion. The accommodating portion communicates with the front end and the rear end. The accommodating portion has an upper portion, a lower portion and side portions. The side portions are formed on respective opposite ends in a width direction of the accommodating portion so as to couple the upper portion and the lower portion with each other. The resilient lock portion is formed in the accommodating portion so as to be separated from both the upper portion and the lower portion. The lever is accommodated in the accommodating portion so as to be pivotable between a first position and a second position through a third position. The lever is configured to mate the connector with the mating connector when the lever pivots to the second position after the mating connector is inserted into the connector from the front end under a state where the lever is located between the third position and the first position. The resilient lock portion is configured to receive the lever when the lever is located at the third position under a state where the mating connector is not inserted in the connector so that the lever is temporarily prevented from pivoting toward the second position beyond the third position. The attached member is other than the housing. The attached member is attached to the rear end of the housing so as to support a rear end of the resilient lock portion receiving the lever located at the third position.

Yet another aspect (third aspect) of the present invention provides a connector matable with a mating connector. The connector comprises a housing, a lever and an attached member. The housing has a front end, a rear end and an accommodating portion. The accommodating portion communicates with the front end and the rear end. The lever is accommodated in the accommodating portion so as to be pivotable between a first position and a second position through a third position. The lever is configured to mate the connector with the mating connector when the lever pivots to the second position after the mating connector is inserted into the connector from the front end under a state where the lever is located between the third position and the first position. The attached member is other than the housing. The attached member is attached to the rear end of the housing so as to be brought into abutment with the lever located at the first position. The abutment prevents the lever from pivoting beyond the first position so as to be apart from the second position.

According to the third aspect of the present embodiment, while a member which determines the pivoting limit of the lever is located at the rear end of the housing, the member is other than the housing. In other words, the member is configured not to interfere the lever when the lever is installed into the accommodating portion. Moreover, the shaft receiver is not removed from the pivot shaft until the lever is lifted a distance of the thickness of itself. In other words, the shaft receiver does not easily come out of the pivot shaft.

An appreciation of the objectives of the present invention and a more complete understanding of its structure may be had by studying the following description of the preferred embodiment and by referring to the accompanying drawings.

DESCRIPTION OF PREFERRED EMBODIMENTS

Figure 1:
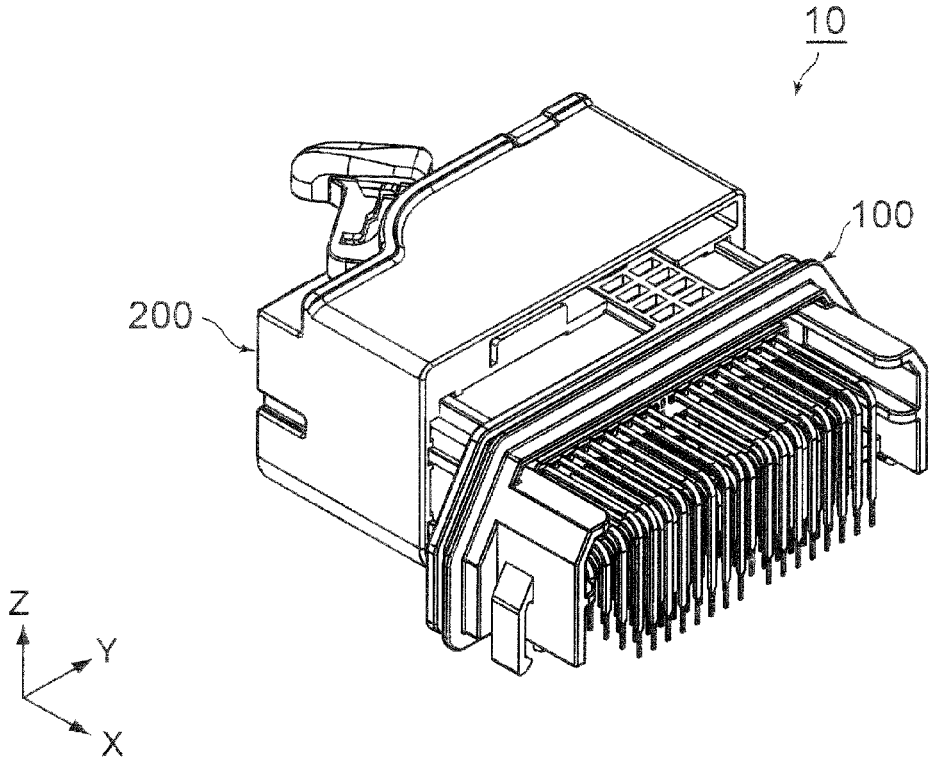
FIG. 1 is a perspective view showing a connector assembly according to an embodiment of the present invention.

As shown in FIG. 1, a connector assembly 10 according to an embodiment of the present invention comprises a male connector (mating connector) 100 and a female connector (connector) 200 matable with the male connector 100.

Figure 2:
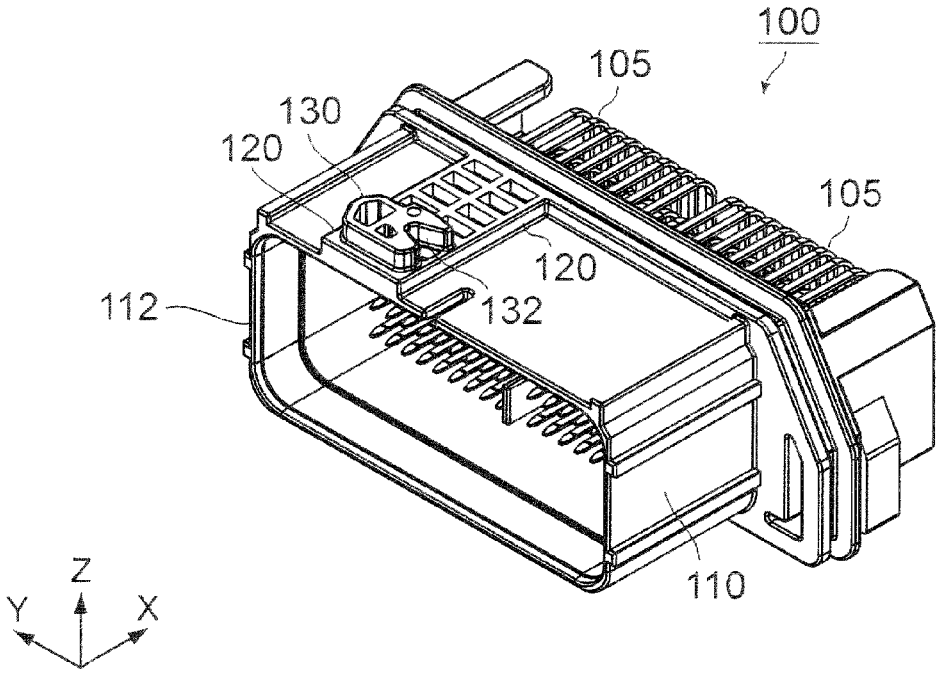
FIG. 2 is a perspective view showing a male connector of the connector assembly of FIG. 1.
Figure 3:
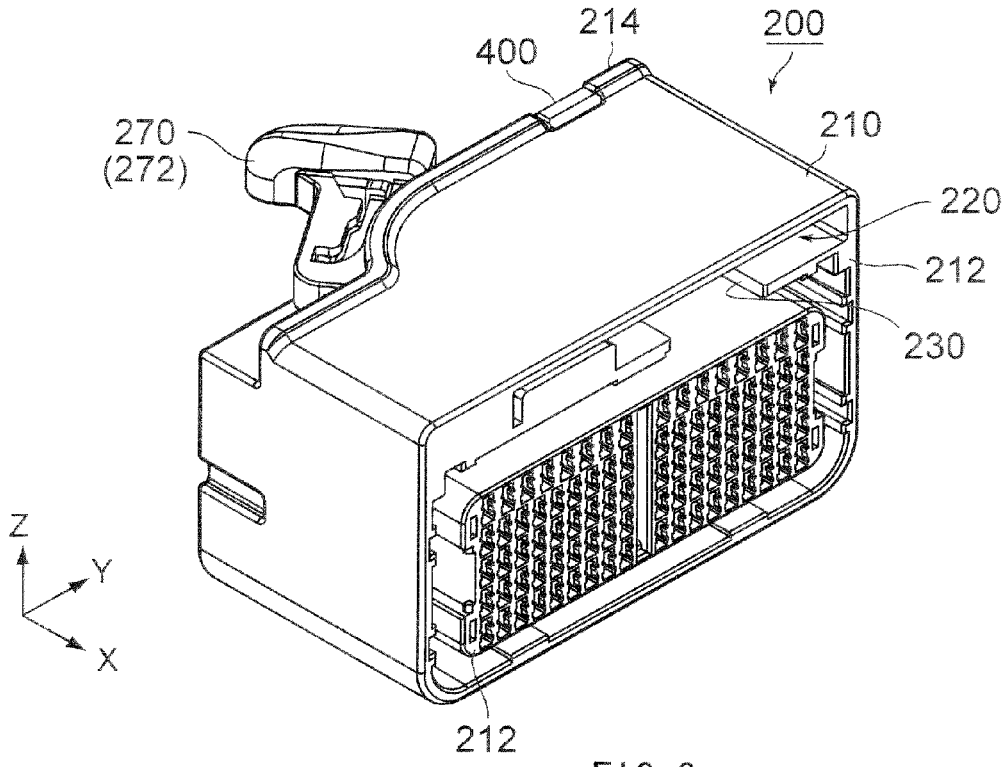
FIG. 3 is a front, perspective view showing a female connector of the connector assembly of FIG. 1, wherein a lever of the female connector is located at a first position.

As shown in FIG. 2, the male connector 100 comprises a plurality of male contacts 105 each made of a metal and a male housing 110 made of an insulating material. The male housing 110 holds the male contacts 105. The male housing 110 has a male mating portion 112. The male mating portion 112 has a square-cylindrical shape which has a rectangular cross-section. The male housing 110 has a guided portion 120 formed on an upper surface of the male mating portion 112. The guided portion 120 has a plate-like shape which protrudes in the positive Z-direction (i.e. protrudes upward) from the male mating portion 112 while extending in the X-direction (front-to-rear direction). The male housing 110 further has a cam portion 130 formed on the guided portion 120. The cam portion 130 further protrudes in the positive Z-direction from the guided portion 120 so as to have an island-like shape. The cam portion 130 is provided with an engaged depression 132. The engaged depression 132 is depressed in the positive Y-direction.

As shown in FIGS. 3 to 6, the female connector 200 comprises a female housing (housing) 210 made of an insulating material, a lever 270 made of an insulating material, and a rear cover 300. The female connector 200 according to the present embodiment is a so-called water-proof connector. Accordingly, the female connector 200 further comprises a plurality of female contacts configured to be connected to the respected male contacts 105, and a sealing member. However, the female contact and the sealing member are not shown in Figures and not described any more in order to clarify the point of the present invention.

Figure 8:
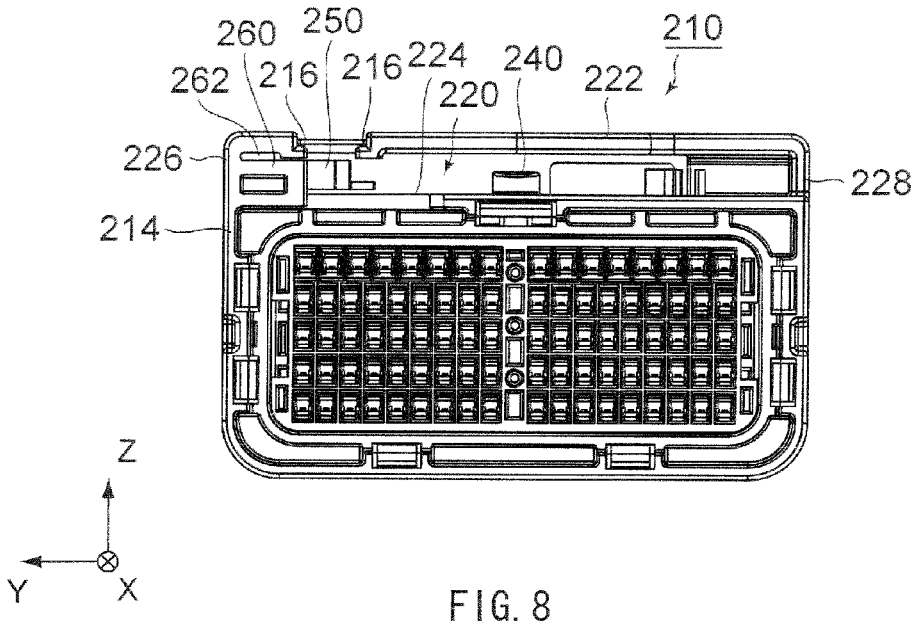
FIG. 8 is a rear view showing the female housing of FIG. 7.
Figure 9:
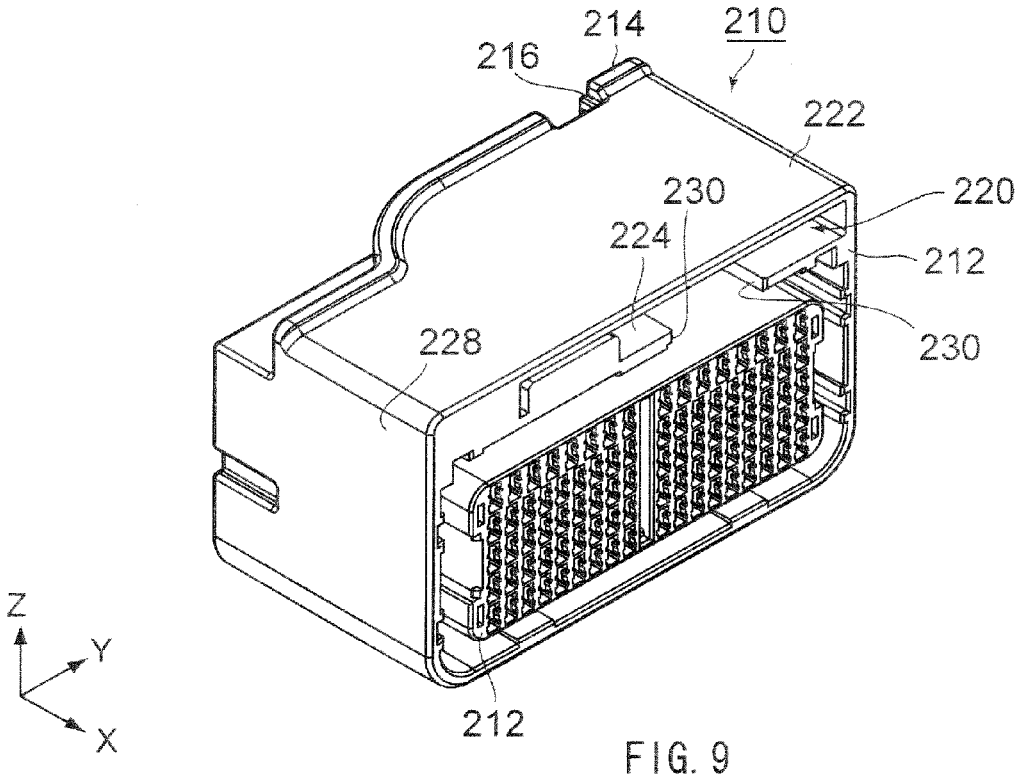
FIG. 9 is a front, perspective view showing the female housing of FIG. 7.
Figure 10:
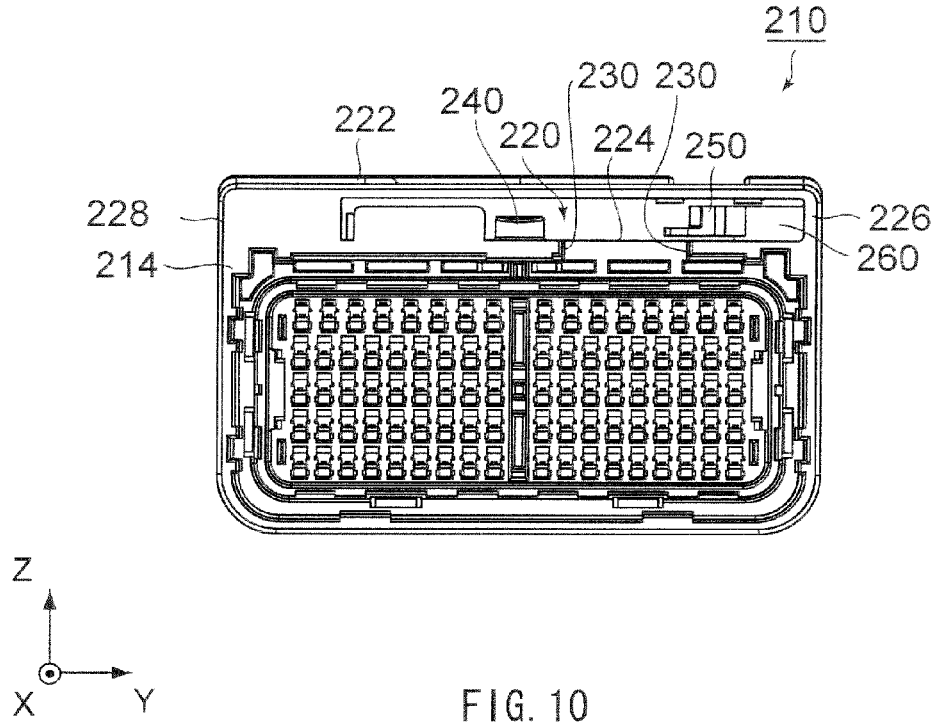
FIG. 10 is a front view showing the female housing of FIG. 9.
Figure 23:
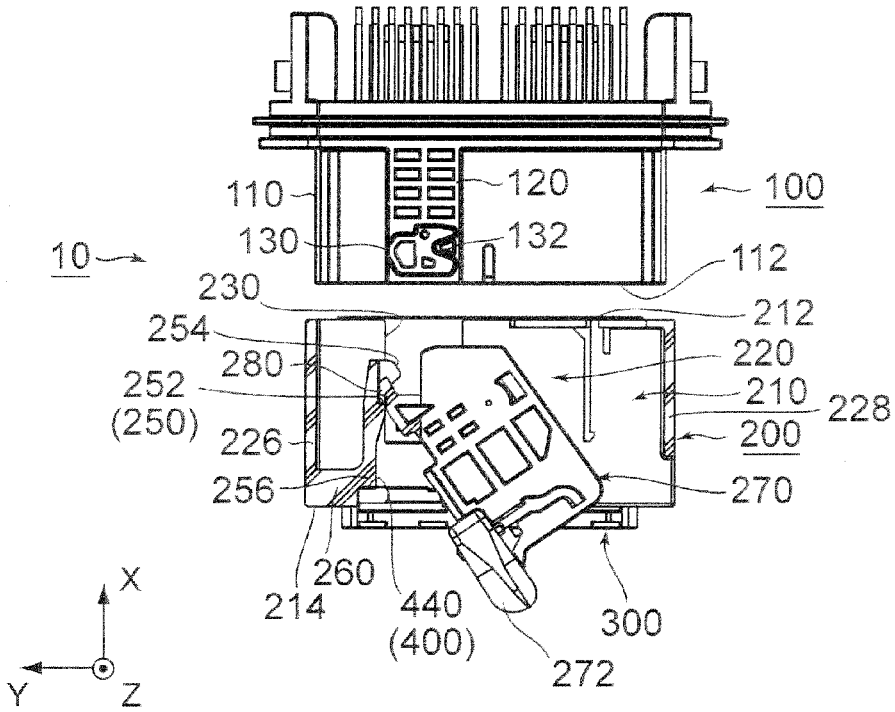
FIG. 23 is a top view showing the connector assembly of FIG. 1 in a state where the male connector and the female connector is not yet tentatively mated (i.e. partially mated) with each other, wherein the female housing and the lever are partially cut away.
Figure 24:
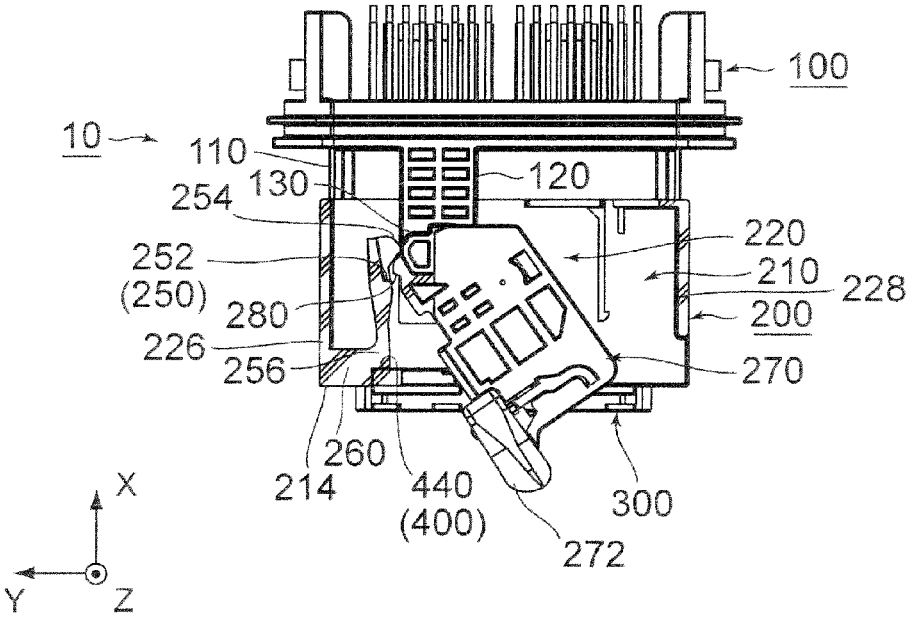
FIG. 24 is a top view showing the connector assembly of FIG. 23 in a state where the male connector and the female connector is tentatively mated with each other While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

As shown in FIGS. 7 to 10, the female housing 210 has a front end 212, a rear end 214 and an accommodating portion 220. The front end 212 functions as a female mating portion. The accommodating portion 220 communicates with the front end 212 and the rear end 214. The accommodating portion 220 has an upper portion (top plate) 222, a lower portion 224, and side portions 226 and 228. The side portions 226 and 228 are formed on respective opposite ends in the Y-direction (width direction) of the accommodating portion 220 so as to couple the upper portion 222 and the lower portion 224 with each other. As shown in FIGS. 9 and 10, the lower portion 224 of the accommodating portion 220 is formed with a guide portion 230. The guide portion 230 has a width (i.e. a length in the Y-direction) corresponding to a width of the guided portion 120. The guide portion 230 extends in the negative X-direction (i.e. extends rearward) from the front end 212. The guide portion 230 pierces the lower portion 224 in the Z-direction (upper-to-lower direction). As shown in FIGS. 23 and 24, when the male connector 100 and the female connector 200 are mated with each other, the guide portion 230 guides the guided portion 120 so that the guided portion 120 does not wander in the Y-direction. In other words, when the male connector 100 and the female connector 200 are mated with or removed from each other, the guide portion 230 guides the guided portion 120 so that the cam portion 130 moves not in the Y-direction (width direction) but only in the X-direction (front-to-rear direction).

Figure 11:
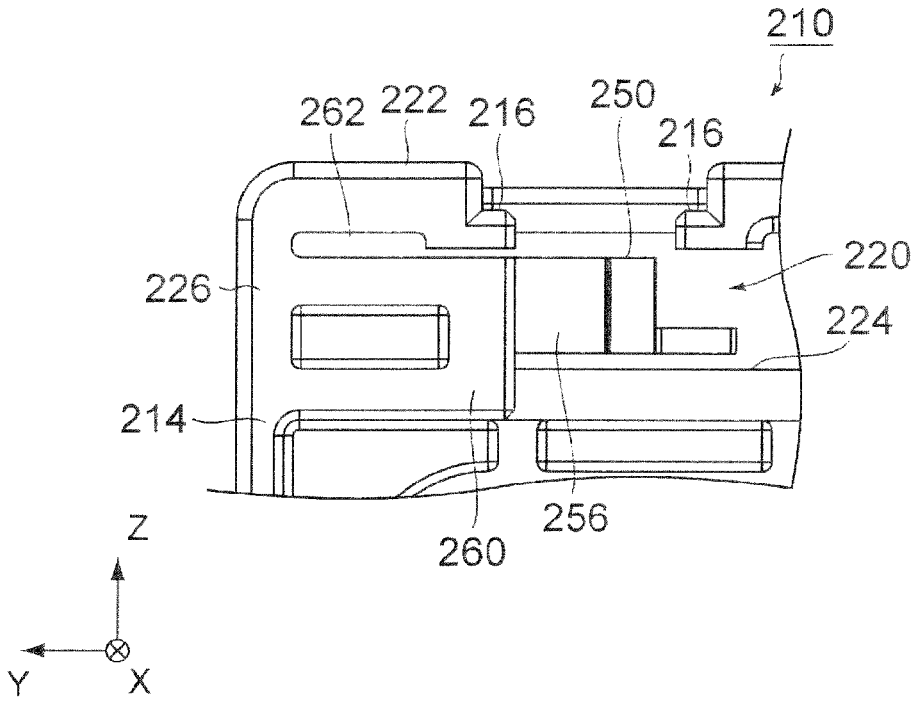
FIG. 11 is a partially-enlarged, rear view showing about a resilient lock portion provided in the female housing of FIG. 8.
Figure 12:
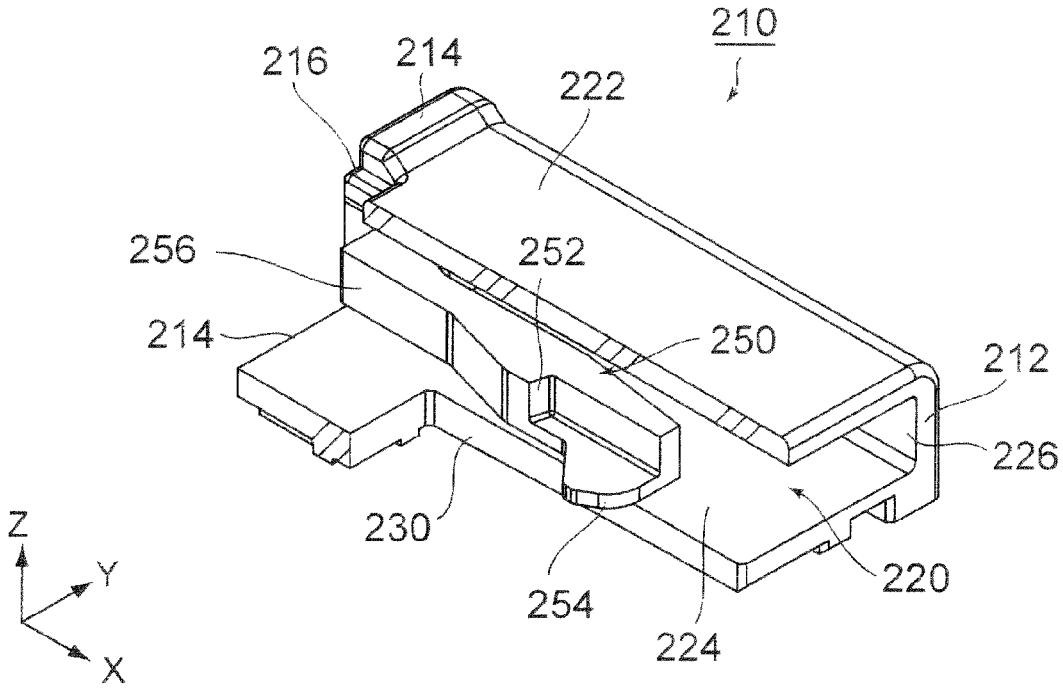
FIG. 12 is a perspective view showing about the resilient lock portion of FIG. 11, wherein the female housing is partially cut away so that the resilient lock portion can be seen.
Figure 13:
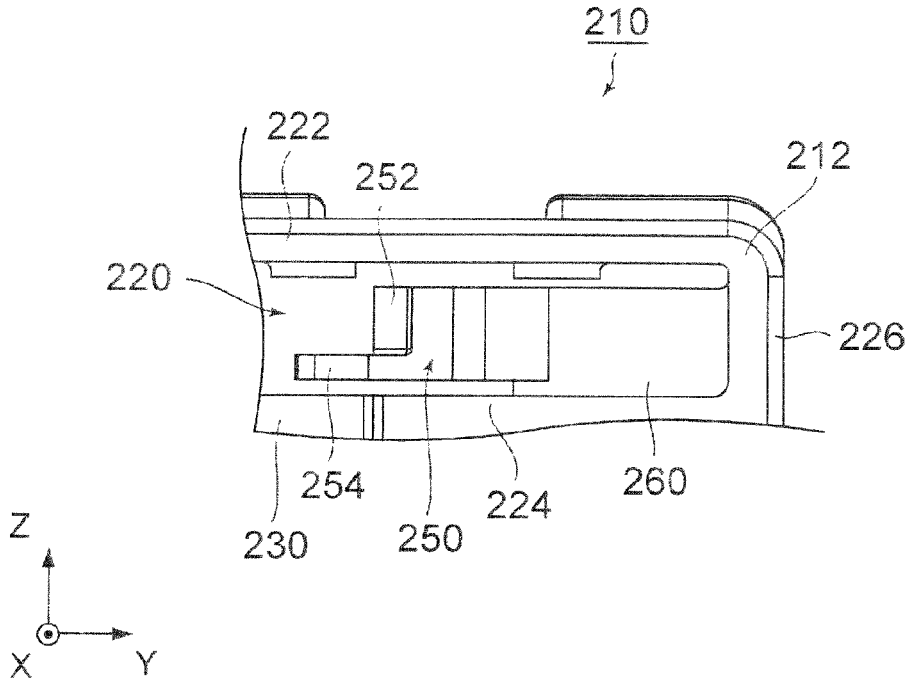
FIG. 13 is a partially-enlarged, front view showing about the resilient lock portion provided in the female housing of FIG. 10.

As shown in FIGS. 8 and 10, the female housing 210 has a pivot shaft 240, a resilient lock portion 250 and a connecting portion 260 each formed in the accommodating portion 220. The pivot shaft 240 has a low-height cylindrical shape. The pivot shaft 240 protrudes in the accommodating portion 220. More specifically, the pivot shaft 240 protrudes in the positive Z-direction (i.e. upward) from the lower portion 224 of the accommodating portion 220. The resilient lock portion 250 is configured to be resiliently deformed in the XY-plane. As shown in FIG. 12, the resilient lock portion 250 has a rod-like shape extending in the X-direction. In detail, the resilient lock portion 250 has a receive portion 252, a release portion 254 and a rear-end portion 256. The receive portion 252 has a surface crossing the X-direction. The release portion 254 is located at the positive X-side of the resilient lock portion 250 as compared with the receive portion 252 (i.e. located forward of the receive portion 252). More specifically, the release portion 254 according to the present embodiment extends in the positive X-direction from the receive portion 252. As can be seen from FIGS. 12 and 13, the release portion 254 protrudes in the negative Y-direction so as to overlap the guide portion 230 in the Z-direction. As can be seen from FIGS. 11 to 13, the resilient lock portion 250 according to the present embodiment is formed within the accommodating portion 220 so as to be separated from both the upper portion 222 and the lower portion 224. Accordingly, the resilient lock portion 250 has a long part which is able to be resiliently deformed. In other words, the resilient lock portion 250 has a long spring length. The connecting portion 260 is provided at an intersection of the side portion 226 and the rear end 214. In other words, the connecting portion 260 is provided at one of corners of the accommodating portion 220. The connecting portion 260 connects side portion 226 (i.e. one of the side portions 226 and 228) and a side of the rear-end portion 256 of the resilient lock portion 250 with each other. As shown in FIG. 11, the connecting portion 260 is separated from the upper portion 222 of the accommodating portion 220. In detail, the female housing 210 is formed with a slit 262. As seen from the rear (i.e. as seen along the positive X-direction), the slit 262 extends to the side portion 226 (i.e. one of the side portions 226 and 228) in the Y-direction so as to separate the connecting portion 260 and the upper portion 222 from each other. As described above, according to the present embodiment, the resilient lock portion 250 and the connecting portion 260 are separated from (at least) the upper portion 222 so that the upper portion 222 has flexibility. In other words, the upper portion 222 according to the present embodiment is designed so as to be easily deformed resiliently. The female housing 210 further has a coupled portion 216 formed in a step-like shape. The coupled portion 216 is located next to the connecting portion 260 in the negative Y-direction.

Figure 14:
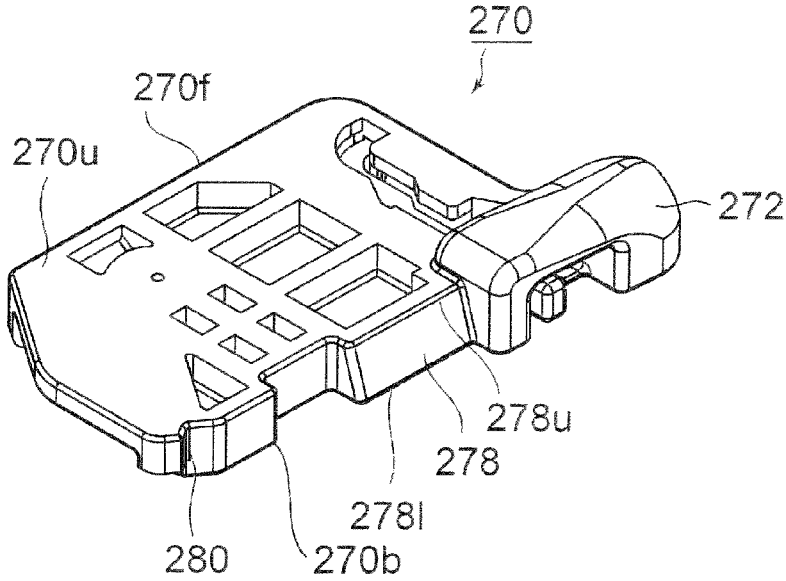
FIG. 14 is a top, perspective view showing a lever of the female connector of FIG. 6.
Figure 15:
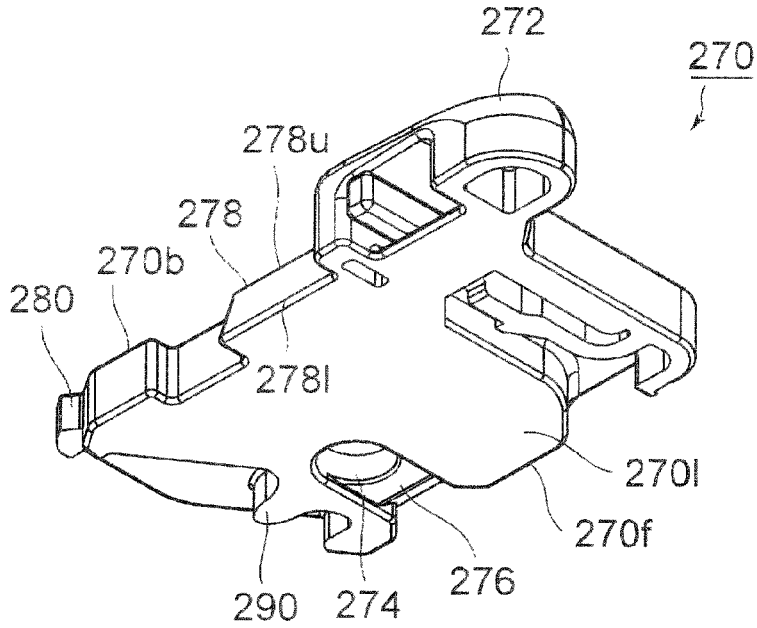
FIG. 15 is a bottom, perspective view showing the lever of FIG. 14.
Figure 21:
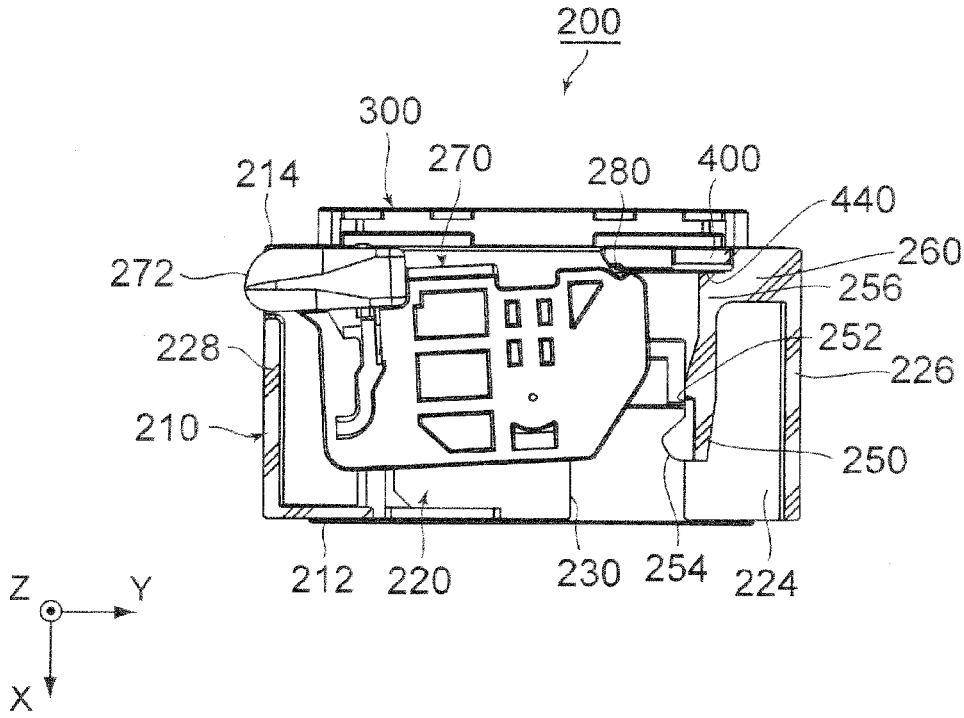
FIG. 21 is a top view showing the female connector of FIG. 18 in a state where the lever is located at the second position.
Figure 22:
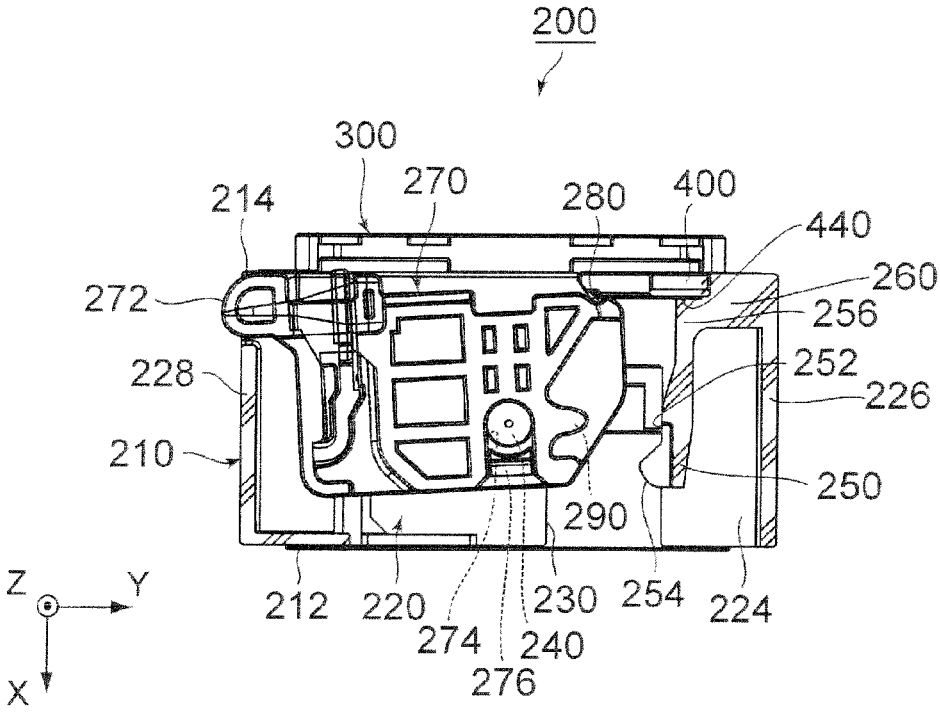
FIG. 22 is a top view showing the female connector of FIG. 21 in the state where the lever is located at the second position, wherein the bottom side part of the lever is illustrated by dashed lines.

Referred to FIGS. 14 and 15, the lever 270 has a roughly-rectangular plate-like shape so as to have a front end 270*f* and a rear end 270*b*. Each of the front end 270*f* and the rear end 270*b* is formed with two corner portions. The lever 270 is formed with an operated portion 272, a shaft receiver 274 and a guide channel 276. The operated portion 272 is formed on one of the corner portions of the rear end 270*b* of the lever 270. The lever 270 is configured so as to pivot by an operation of the operated portion 272. The shaft receiver 274 is configured to be turnably supported by the pivot shaft 240. In detail, when the lever 270 is installed in the accommodating portion 220, the shaft receiver 274 receives the pivot shaft 240 so that the lever 270 is pivotable on the pivot shaft 240. The guide channel 276 extends continuously from the pivot shaft 240. As can be seen from FIGS. 14 and 15, the shaft receiver 274 and the guide channel 276 are provided on a lower surface 2701 of the lever 270. Therefore, the shaft receiver 274 and the guide channel 276 cannot be seen from an upper surface 270*u* of the lever 270. The shaft receiver 274 is formed at a position nearer to the front end 270*f* than the center of the gravity of the lever 270 so as to be a long distance apart from the operated portion 272. In other words, the shaft receiver 274 is located between the center of the gravity of the lever 270 and the front end 270*f*. The guide channel 276 is formed between the front end 270*f* of the lever 270 and the shaft receiver 274. The guide channel 276 is depressed shallower than the shaft receiver 274. According to the present embodiment, the lever 270 is installed into the accommodating portion 220 by using the guide channel 276. More specifically, the lever 270 is press-fitted (i.e. inserted) into the accommodating portion 220 from the rear end 214 of the female housing 210 so that the pivot shaft 240 and the guide channel 276 are located at a same position in the Y-direction (see FIG. 8). Then, the guide channel 276 guides the shaft receiver 274 of the press-fitted lever 270 to the pivot shaft 240. As can be seen from the above description, the lever 270 according to the present embodiment has the guide channel 276 so that an excessive load applied to the upper portion 222 may be avoided when the lever 270 is installed into the accommodating portion 220. As shown in FIGS. 21 and 22, after the lever 270 is installed in the accommodating portion 220, the operated portion 272 of the lever 270 is located at a closest position which is closest to the rear end 214 of the female housing 210. When the operated portion 272 is located at the closest position, the lever 270 is located at a second position.

Figure 19:
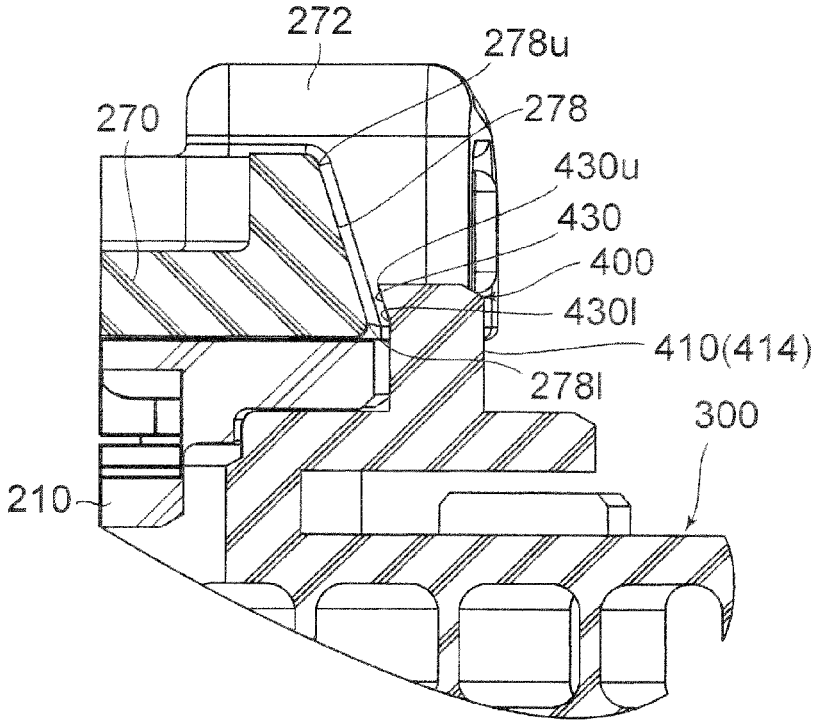
FIG. 19 is a cross-sectional view showing a part of the female connector of FIG. 18, taken along lines XIX-XIX, wherein the lever is located between the first position and a third position.

As shown in FIGS. 14 and 15, the lever 270 has a first abutment portion 278 formed on the rear end 270*b* thereof. The first abutment portion 278 is located in the vicinity of the operated portion 272. The first abutment portion 278 has an upper end 278*u* and a lower end 278*l*. As shown in FIGS. 14, 15 and 19, the first abutment portion 278 has a shape where the lower end 278*l* protrudes in the horizontal plane as compared with the upper end 278*u*. More specifically, the first abutment portion 278 is a slope extending obliquely from the upper end 278*u* to the lower end 278*l*.

The lever 270 is formed with a received portion 280 in the vicinity of the other corner portion of the rear end 270*b* thereof. The received portion 280 is configured to be temporarily received to be stopped (i.e. temporarily locked) by the receive portion 252 of the resilient lock portion 250. The first abutment portion 278 is located between the received portion 280 and the operated portion 272. As can be seen from FIG. 20, if the lever 270 is forced to pivot toward the second position under a state where the received portion 280 is located forward of the receive portion 252 of the resilient lock portion 250 in the positive X-direction (i.e. located between the receive portion 252 and the front end 212 in the X-direction), the received portion 280 is brought into abutment with the receive portion 252. When the received portion 280 is brought into abutment with the receive portion 252, the lever 270 is located at a third position. As described above, when the received portion 280 is located forward of the receive portion 252 of the resilient lock portion 250 in the positive X-direction, the lever 270 is unable to move toward the second position beyond the third position even if the lever 270 is forced to pivot toward the second position. In other words, the resilient lock portion 250 is configured to temporarily prevent the lever 270 from pivoting toward the second position beyond the third position.

Figure 20:
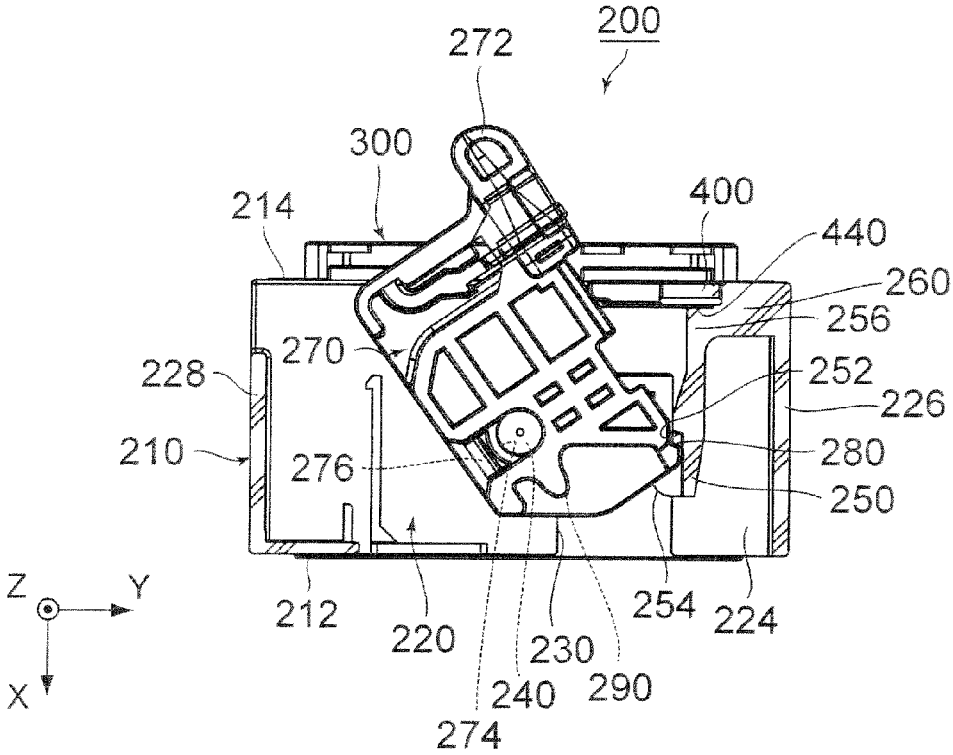
FIG. 20 is a top view showing the female connector of FIG. 18 in the state where the lever is located at the first position, wherein a bottom side part of the lever is illustrated by dashed lines.

As shown in FIGS. 15, 20 and 22, the lever 270 is formed with a pinion protrusion 290. The pinion protrusion 290 is located forward of the received portion 280 in the positive X-direction. The pinion protrusion 290 protrudes in the radial direction centered on the shaft receiver 274. As can be seen from FIGS. 20 and 22, the pinion protrusion 290 protrudes over the guide portion 230. As can be seen from FIGS. 23 and 24, when the male connector 100 and the female connector 200 are mated with each other, the cam portion 130 moves on a moving pass which extends along the negative X-direction. The pinion protrusion 290 protrudes on the moving path so as to interfere the cam portion 130.

Figure 4:
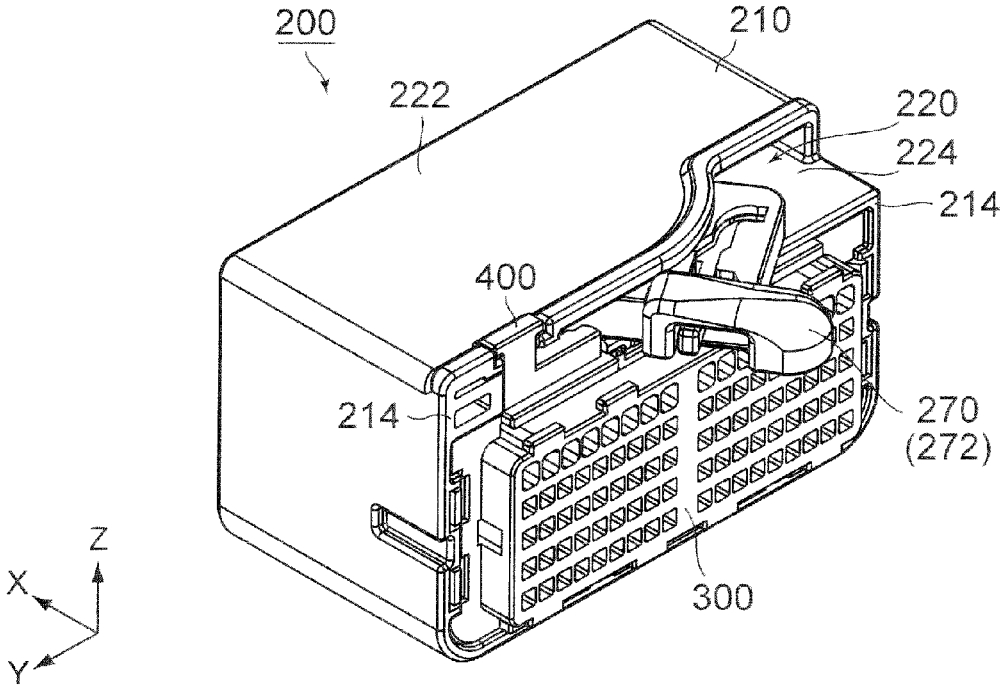
FIG. 4 is a rear, perspective view showing the female connector of FIG. 3, wherein the lever is located at the first position.
Figure 5:
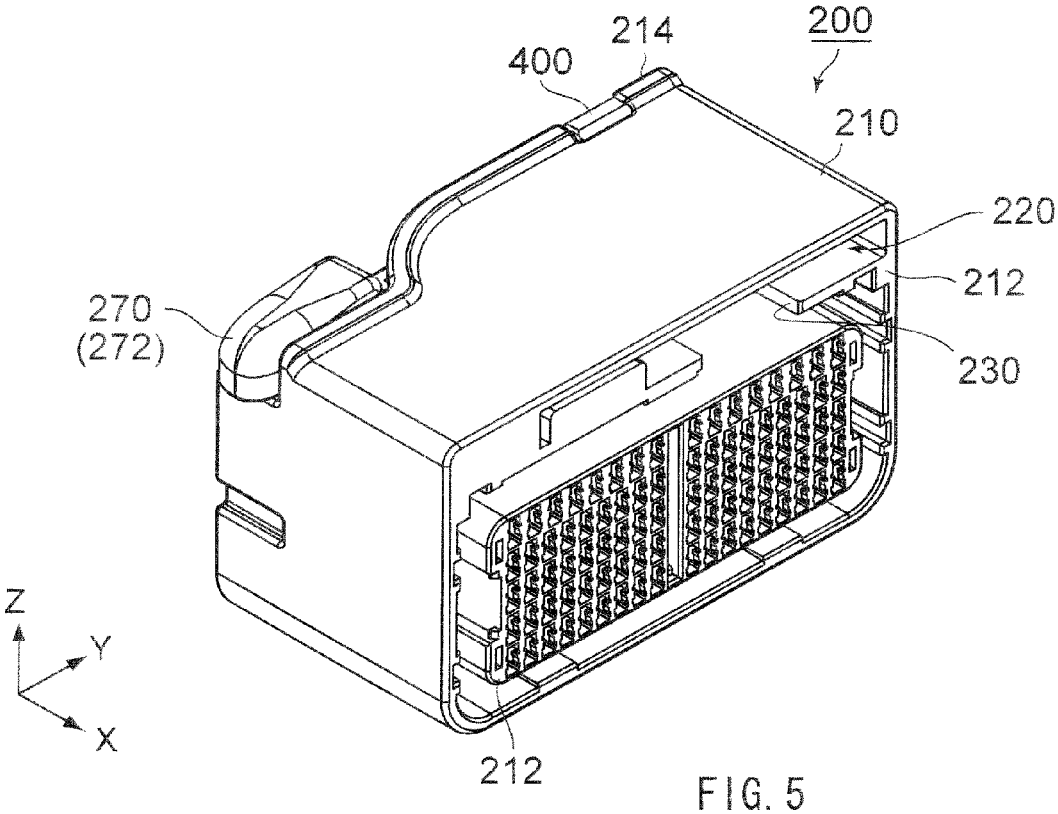
FIG. 5 is a front, perspective view showing the female connector of FIG. 3, wherein the lever is located at a second position.
Figure 6:
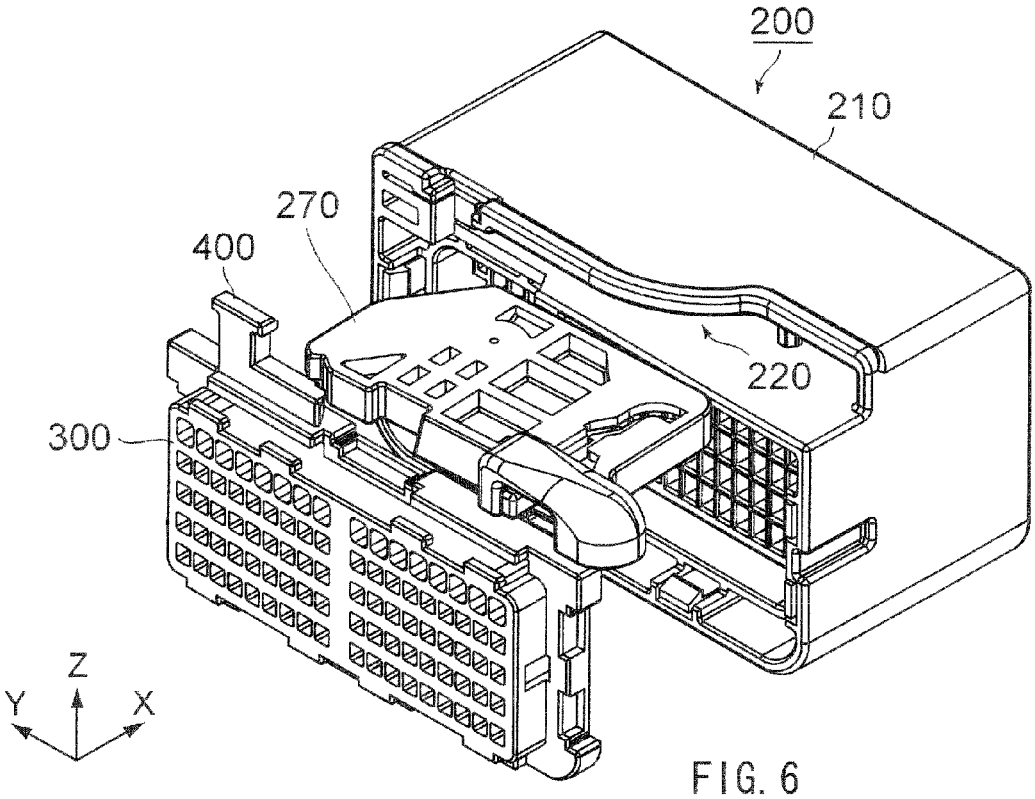
FIG. 6 is an exploded, perspective view showing the female connector of FIG. 3.
Figure 7:
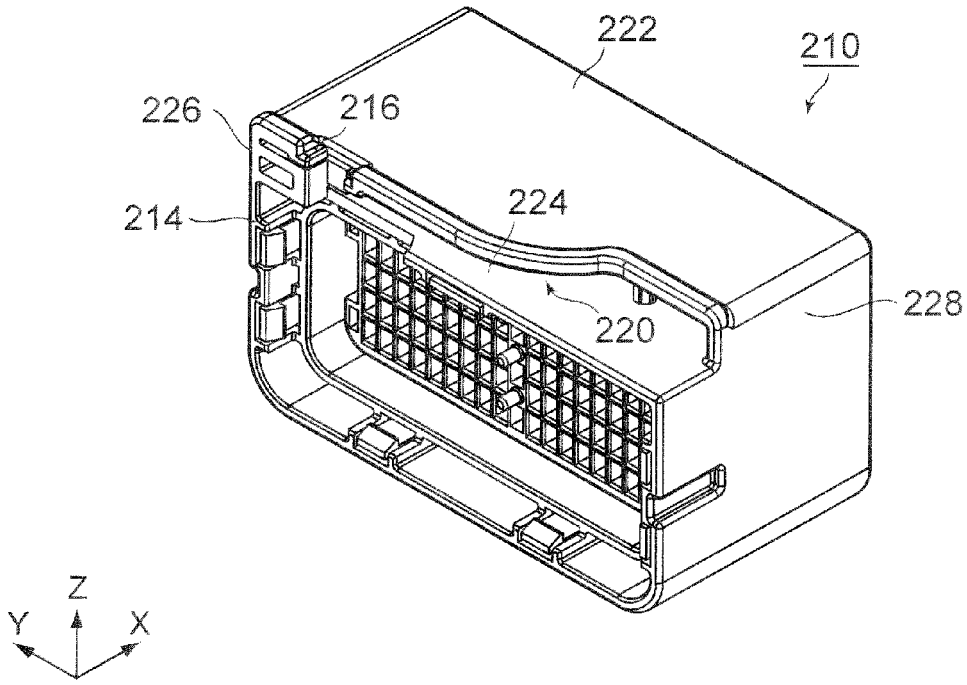
FIG. 7 is a rear, perspective view showing a female housing of the female connector of FIG. 6.
Figure 16:
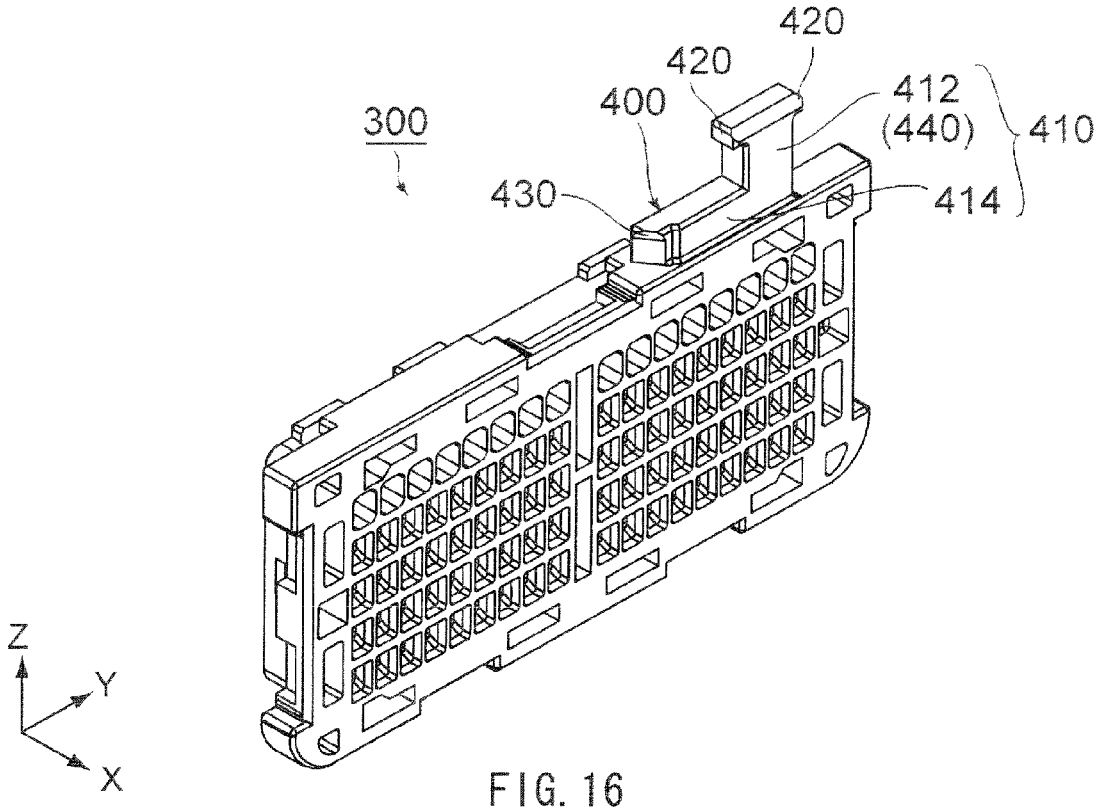
FIG. 16 is a perspective view showing a rear cover of the female connector of FIG. 6.

As shown in FIG. 4, the rear cover 300 is attached to the rear end 214 of the female housing 210. As can be seen from FIGS. 4 and 6, the rear cover 300 according to the present embodiment is fixed to a lower part of the female housing 210. As shown in FIG. 16, the rear cover 300 is integrally formed with an attached member 400. In other words, the attached member 400 according to the present embodiment is formed as a part of the rear cover 300. The attached member 400 is other than the female housing 210 (i.e. is not a part of the female housing 210). More specifically, the attached member 400 is formed separately from the female housing 210. The attached member 400 may be formed separately from the rear cover 300 provided that the attached member 400 is formed separately from the female housing 210.

Figure 17:
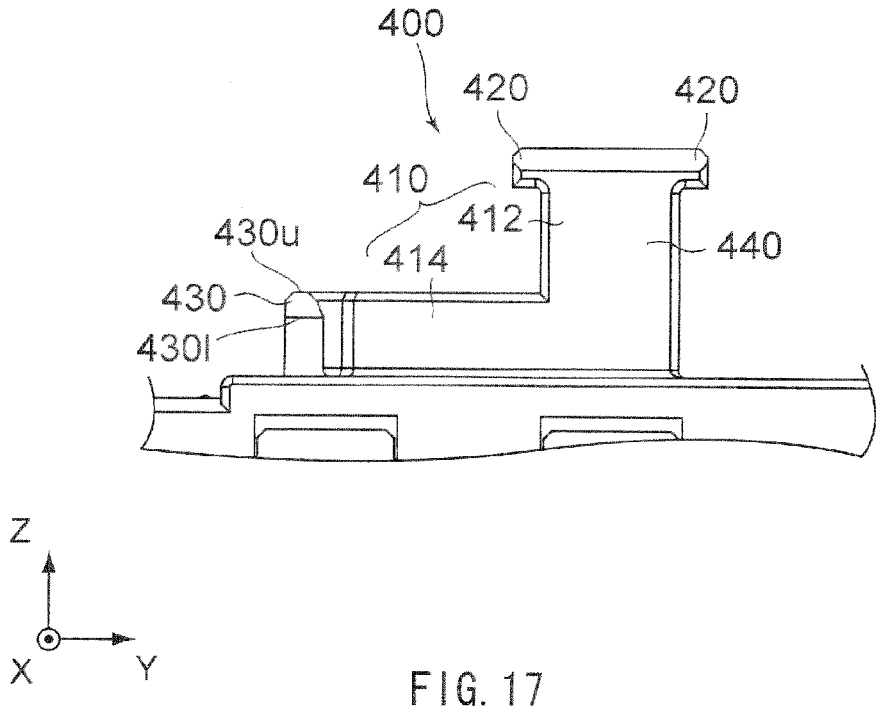
FIG. 17 is a partially-enlarged, front view showing about an attached member which is formed as a part of the rear cover of FIG. 16.

As shown in FIGS. 16 and 17, the attached member 400 has a body portion 410. The body portion 410 has an L-like shape. In detail, the body portion 410 has a vertical portion 412 extending in the positive Z-direction (i.e. extending upward) and a lateral portion 414 extending in the negative Y-direction (width direction). The vertical portion 412 is formed with a coupling portion 420 on the positive Z-side end (i.e. upper end) thereof. The coupling portion 420 protrudes in both the positive and negative Y-direction. The attached member 400 is attached to the rear end 214 of the female housing 210 so as to be located rearward of the lever 270. In detail, the coupling portion 420 is fitted into the coupled portion 216 of the female housing 210 (i.e. the attached member 400 is attached to the female housing 210) so that the attached member 400 couples the upper portion 222 and the lower portion 224 of the accommodating portion 220 with each other. Especially, the attached member 400 according to the present embodiment is attached to the female housing 210 so as to couple the upper portion 222 and the lower portion 224 with each other at a position located between the side portions 226 and 228 in the Y-direction. As can be seen from the above description, the accommodating portion 220 is strengthened by the attached member 400 when the attached member 400 is attached to the rear end 214 of the female housing 210 so that a deformation of the upper portion 222 is suppressed. Therefore, it is possible to prevent the lever 270 from being removed (i.e. coming out of the accommodating portion 220) because of the resilient deformation of the upper portion 222. On the other hand, the upper portion 222 is resiliently deformed easily while the lever 270 is installed into the accommodating portion 220 (i.e. when the attached member 400 is not attached to the female housing 210). Therefore, it is possible to prevent the upper portion 222 and the lever 270 from being damaged when the lever 270 is installed into the accommodating portion 220. According to the present embodiment, the attached member 400 other than the female housing 210 couples the upper portion 222 and the lower portion 224 with each other so that the lever 270 is easily installed into the accommodating portion 220 while the installed lever 270 is prevented from being removed. It is desirable that the attached member 400 couples the upper portion 222 and the lower portion 224 with each other at a position as near as possible to the center in the Y-direction so as to more effectively reduce the deformation of the upper portion 222, provided that the lever 270 is pivotable in a necessary range. Moreover, it is desirable that a width (i.e. a length in the Y-direction) of the vertical portion 412 of the body portion 410 is as large as possible.

As shown in FIGS. 16 and 17, the attached member 400 has a second abutment portion 430 formed on an end portion of the lateral portion 414. A distance between the second abutment portion 430 (or the attached member 400) and a center of pivot (i.e. the shaft receiver 274) of the lever 270 is longer than a distance between the front end 270*f* of the lever 270 and the center of pivot. The second abutment portion 430 has an upper end 430*u* and a lower end 430I. As can be seen from FIGS. 17 and 19, the second abutment portion 430 has a shape where the upper end 430*u* protrudes in the horizontal plane as compared with the lower end 430I. More specifically, the second abutment portion 430 is a slope extending obliquely from the lower end 430I to the upper end 430*u*. As can be seen from FIG. 19, the slope of the second abutment portion 430 is designed so as to be brought into surface contact with the slope of the first abutment portion 278. In detail, the first abutment portion 278 and the second abutment portion 430 are brought into abutment with each other when the lever 270 pivots so as to be apart from the second position. The lever 270 is located at a first position when the first abutment portion 278 is brought into abutment with the second abutment portion 430. Conversely, the slope of the first abutment portion 278 and the slope of the second abutment portion 430 are in surface contact with each other when the lever 270 is located at the first position. As can be seen from the above description, the attached member 400 according to the present embodiment is attached to the rear end 214 of the female housing 210 so as to be brought into abutment with the lever 270 located at the first position. The abutment prevents the lever 270 from pivoting beyond the first position so as to move away from the second position. In other words, the first abutment portion 278 and the second abutment portion 430 are brought into abutment with each other when the lever 270 is located at the first position so that the lever 270 is unable to pivot beyond the first position to be apart from the second position. Moreover, the first abutment portion 278 of the lever 270 receives a downward force from the second abutment portion 430 so that it is possible to prevent the lever 270 from being lifted to press the upper portion 222 of the accommodating portion 220 in the positive Z-direction. In other words, it is possible to prevent the lever 270 from coming out of the pivot shaft 240. Especially, according to the present embodiment, a distance between the center of pivot of the lever 270 and the second abutment portion 430 is long so that it is possible to more securely regulate the pivot of the lever 270 as compared with an existing connector.

The lever 270 is configured to pivot on the center of the pivot within a predetermined range (i.e. pivoting range). The first position is one of pivoting limits (i.e. boundaries of the pivoting range) of the lever 270. The other pivoting limit is the second position. The third position is located between the first position and the second position. In other words, the lever 270 according to the present embodiment is accommodated in the accommodating portion 220 so as to be pivotable between the first position and the second position through the third position As can be seen from FIGS. 18 and 20, when the received portion 280 is located forward of the receive portion 252 of the resilient lock portion 250, the lever 270 is located between the first position and the third position (including the first position and the third position). As previously described, the resilient lock portion 250 is configured to receive the lever 270 when the lever 270 is located at the third position under a state where the male connector 100 is not inserted in the female connector 200. In detail, if the lever 270 located between the first position and the third position is forced to pivot to the second position, the received portion 280 of the lever 270 is received by the receive portion 252 of the resilient lock portion 250 so that the lever 270 is temporarily prevented from pivoting toward the second position beyond the third position. In other words, the lever 270 is temporarily locked at the third position by the abutment of the receive portion 252 with the received portion 280. According to the present embodiment, the connecting portion 260 is adjacent to the attached member 400 (i.e. the connecting portion 260 and the attached member 400 are arranged side by side) in the Y-direction (width direction). Moreover, the vertical portion 412 of the body portion 410 has a front surface which serves as a backup portion 440. The backup portion 440 of the attached member 400 receives the rear-end portion 256 of the resilient lock portion 250 from behind so as to support the resilient lock portion 250. The stiffness of the resilient lock portion 250 is increased by the backup portion 440 so that it is possible to more certainly prevent the temporal lock of the lever 270 from being released unintentionally. Especially, the backup portion 440 of the attached member 400 according to the present embodiment is larger than the rear-end portion 256 of the resilient lock portion 250 in the Y-direction (width direction) so that it is possible to support the resilient lock portion 250 more securely. As shown in FIG. 23, according to the present embodiment, the backup portion 440 is placed to be closed to the rear-end portion 256 of the resilient lock portion 250. However, the backup portion 440 may be differently placed provided that the backup portion 440 is brought into abutment with the rear-end portion 256 of the resilient lock portion 250 when the receive portion 252 of the resilient lock portion 250 receives the received portion 280 of the lever 270. For example, the backup portion 440 may be a little apart from the rear-end portion 256 of the resilient lock portion 250 when the receive portion 252 of the resilient lock portion 250 does not receive the received portion 280 of the lever 270.

The resilient lock portion 250 is resiliently deformable in the positive Y-direction without being interfered. In other words the receive portion 252 and the release portion 254 is able to move toward the positive Y-side (i.e. toward the side portion 226). For example, the resilient lock portion 250 is able to be deformed easily when the lever 270 is moved to a state where the received portion 280 is located forward of the receive portion 252 (see FIGS. 18 and 20) after being installed in the female housing 210 (see FIGS. 21 and 22).

Figure 18:
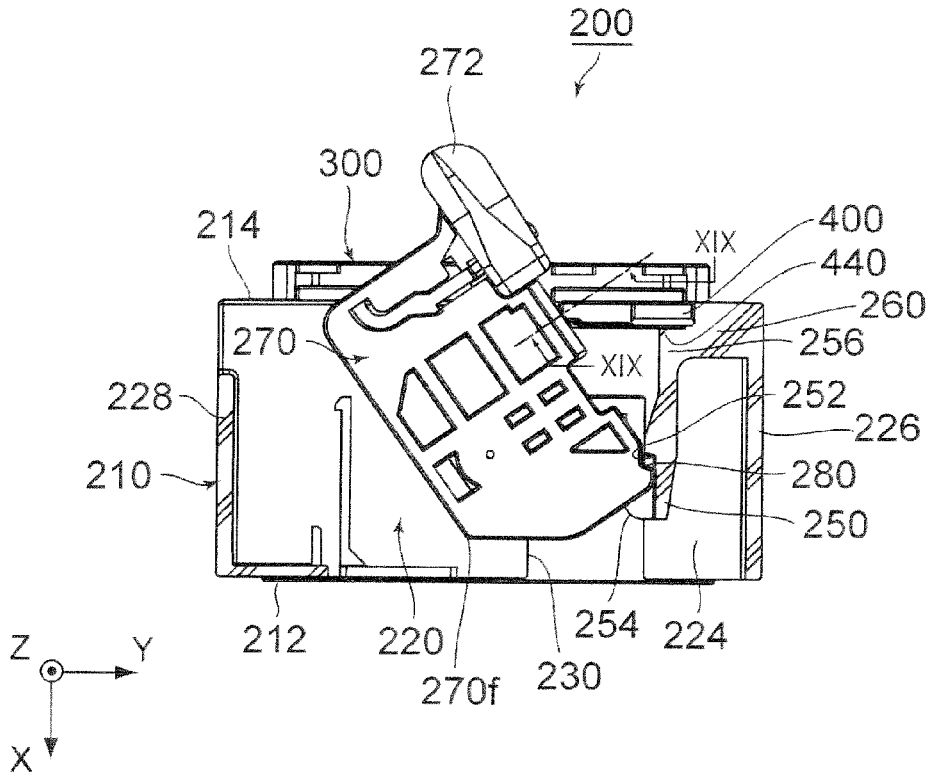
FIG. 18 is a top view showing the female connector of FIG. 6 in a state where the lever is located at the first position, wherein the female housing is partially cut away so that the lever can be seen.

As can be seen from FIGS. 18, 20 and 23, the lever 270 is configured to mate the male connector 100 with the female connector 200 when the lever 270 pivots to the second position after the male connector 100 is inserted into the female connector 200 from the front end 212 under a state where the lever 270 is located between the third position and the first position. In detail, the pinion protrusion 290 is able to be engaged with the engaged depression 132 of the cam portion 130 when the lever 270 is located between the first position and the third position (including the first position and the third position). In other words, as shown in FIG. 24, the male connector 100 and the female connector 200 are able to be tentatively mated (i.e. partially mated) with each other. When the male connector 100 and the female connector 200 are partially mated with each other, the release portion 254 of the resilient lock portion 250 is pressed toward the positive Y-side (i.e. toward the side portion 226) by the cam portion 130 so that the resilient lock portion 250 is resiliently deformed to move the receive portion 252 toward the positive Y-side (i.e. toward the side portion 226). Accordingly, the receive portion 252 and the received portion 280 are placed at different positions from each other in the Y-direction (width direction) so that the lever 270 is enabled to pivot toward the second position. As the operated portion 272 of the lever 270 is pushed forward (i.e. pushed to approach the rear end 214 of the female housing 210) under a state where the pinion protrusion 290 is engaged with the engaged depression 132, the male connector 100 and the female connector 200 become to be more securely mated with each other. When the lever 270 pivots to arrive at the second position, the male connector 100 and the female connector 200 are (completely) mated with each other (i.e. the female connector 200 is in a completely mated state).

According to the present embodiment, the female connector 200 comprises the attached member 400 other than the female housing 210 (i.e. distinct from the female housing 210). The attached member 400 is attached to the rear end 214 of the female housing 210. The attached member 400 is able to serve as a means to strengthen the accommodating portion 220 or a means to determine the pivoting limit of the lever 270. As can be seen from the above description, according to the present embodiment, it is possible to heighten the degree of freedom on designing the lever 270 and the female housing 210. Moreover, it is possible to easily strengthen the lever 270 and the female housing 210.

Moreover, it is possible to lengthen the resilient lock portion 250 (i.e. to lengthen the spring length) so that the resilient lock portion 250 is able to be resiliently deformed flexibly (i.e. easily) by a force along the Y-direction. On the other hand, when the resilient lock portion 250 temporarily locks the lever 270, the resilient lock portion 250 is strengthened so as not to be deformed by a force along the negative X-direction. As described below, the aforementioned two effects are realized by comprising the attached member 400 other than the female housing 210. According to a general forming method, a certain amount of space behind the resilient lock portion 250 is necessary when integrally forming the resilient lock portion 250 with the female housing 210 while separating the resilient lock portion 250 from the upper portion (top plate) 222 and the lower portion 224 of the accommodating portion 220. In this case, the aforementioned space (i.e. necessary space in forming process) exists rearward of the resilient lock portion 250 so that it is impossible to directly support the resilient lock portion 250 from behind. According to the present embodiment, even if the necessary space in forming process exists rearward of the resilient lock portion 250, it is possible to attach the attached member 400 to the rear end 214 of the female housing 210 so as to support the rear-end portion 256 of the resilient lock portion 250 receiving the lever 270 located at the third position. In other words, according to the present embodiment, it is possible to realize the aforementioned two effects.

This invention is not limited to the embodiment described above. According to the embodiment described above, the rear cover 300 is not formed with a part protruding toward the positive X-side (i.e. protruding forward). However, the attached member 400 of the rear cover 300 may be formed with a protruding portion which protrudes toward the positive X-side (i.e. protrudes forward). For example, the protruding portion of the attached member 400 may be configured to be brought into abutment with a pressed part of the rear-end portion 256 of the resilient lock portion 250. The aforementioned pressed part of the rear-end portion 256 may be a part which faces the side portion 228 of the female housing 210 in the Y-direction. The protruding portion of the attached member 400 may be a part of the backup portion 440. In this case, the attached member 400 has an L-like shaped cross-section in the XY-plane.

This invention is applicable to a connector comprising a lever For example, this invention is applicable to a waterproof connector such as a connector according to the embodiment described above.

The present application is based on a Japanese patent application of JP2011-117784, JP2011-117944 and JP2011-118042 each filed before the Japan Patent Office on May 26, 2011, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector matable with a mating connector, the connector comprising:

a housing having a front end, a rear end and an accommodating portion, the accommodating portion communicating with the front end and the rear end, the accommodating portion having an upper portion, a lower portion and side portions, the side portions being formed on respective opposite ends in a width direction of the accommodating portion so as to couple the upper portion and the lower portion with each other;

a lever accommodated in the accommodating portion so as to be pivotable between a first position and a second position through a third position, the lever being configured to mate the connector with the mating connector when the lever pivots to the second position after the mating connector is inserted into the connector from the front end under a state where the lever is located between the third position and the first position; and an attached member other than the housing, the attached member being attached to the housing so as to couple the upper portion and the lower portion with each other at a position located between the side portions in the width direction.

2. The connector as recited in claim 1, wherein:

the lever is inserted in the accommodating portion from the rear end of the housing; and the attached member is attached to the rear end of the housing so as to be located rearward of the lever.

3. The connector as recited in claim 1, wherein the housing has a resilient lock portion, the resilient lock portion being configured to temporarily prevent the lever from pivoting toward the second position beyond the third position, the resilient lock portion being formed within the accommodating portion so as to be separated from at least the upper portion.

4. The connector as recited in claim 3, wherein:

the housing further has a connecting portion, the connecting portion connecting one of the side portions and a side of a rear-end portion of the resilient lock portion with each other; and the housing is formed with a slit, the slit extending to the one of the side portions in the width direction so as to separate the connecting portion and the upper portion from each other.

5. The connector as recited in claim 4, wherein the connecting portion and the attached member are arranged side by side in the width direction.

6. The connector as recited in claim 3, wherein:

the resilient lock portion is configured to receive the lever when the lever is located at the third position under a state where the mating connector is not inserted in the connector so that the lever is temporarily prevented from pivoting toward the second position beyond the third position, the resilient lock portion being formed in the accommodating portion so as to be separated from both the upper portion and the lower portion; and the attached member is attached to the rear end of the housing so as to support a rear-end portion of the resilient lock portion receiving the lever located at the third position.

7. The connector as recited in claim 6, wherein the housing further has a connecting portion, the connecting portion connecting one of the side portions and a side of the rear-end portion of the resilient lock portion with each other, the connecting portion and the attached member being arranged side by side in the width direction.

8. The connector as recited in claim 6, wherein the attached member receives the rear-end portion of the resilient lock portion from behind.

9. The connector as recited in claim 6, wherein the attached member is larger than the rear-end portion of the resilient lock portion in the width direction.

10. The connector as recited in claim 1, wherein the attached member is attached to the rear end of the housing so as to be brought into abutment with the lever located at the first position, the abutment preventing the lever from pivoting beyond the first position so as to move away from the second position.

11. The connector as recited in claim 10, wherein:

the lever is configured to pivot on a center of pivot; and a distance between the attached member and the center of pivot is longer than a distance between a front end of the lever and the center of pivot.

12. The connector as recited in claim 10, wherein:

the housing has a pivot shaft protruding in the accommodating portion; and the lever is formed with a shaft receiver and a guide channel, the shaft receiver receiving the pivot shaft so that the lever is pivotable on the pivot shaft, the guide channel guiding the shaft receiver to the pivot shaft when the lever is installed into the accommodating portion from the rear end of the housing.

13. The connector as recited in claim 10, wherein:

the lever has a first abutment portion having an upper end and a lower end, the lower end of the first abutment portion protruding as compared with the upper end of the first abutment portion;

the attached member has a second abutment portion having an upper end and a lower end, the upper end of the second abutment portion protruding as compared with the lower end of the second abutment portion; and the first abutment portion and the second abutment portion are brought into abutment with each other when the lever is located at the first position.

14. The connector as recited in claim 13, wherein the first abutment portion and the second abutment portion are in surface contact with each other when the lever is located at the first position.

15. The connector as recited in claim 1, the connector comprising a rear cover attached to the rear end of the housing, wherein the attached member is formed as a part of the rear cover.

16. The connector as recited in claim 3, the connector comprising a rear cover attached to the rear end of the housing, wherein the attached member is formed as a part of the rear cover.

17. The connector as recited in claim 4, the connector comprising a rear cover attached to the rear end of the housing, wherein the attached member is formed as a part of the rear cover.

18. The connector as recited in claim 6, the connector comprising a rear cover attached to the rear end of the housing, wherein the attached member is formed as a part of the rear cover.

19. The connector as recited in claim 10, the connector comprising a rear cover attached to the rear end of the housing, wherein the attached member is formed as a part of the rear cover.

20. The connector as recited in claim 13, the connector comprising a rear cover attached to the rear end of the housing, wherein the attached member is formed as a part of the rear cover.

* * * * *